US011219564B2

(12) United States Patent
Shih

(10) Patent No.: US 11,219,564 B2
(45) Date of Patent: Jan. 11, 2022

(54) ELECTRIC BED

(71) Applicant: Chuan-Hang Shih, Changhua County (TW)

(72) Inventor: Chuan-Hang Shih, Changhua County (TW)

( * ) Notice: Subject to any disclaimer, the term of this patent is extended or adjusted under 35 U.S.C. 154(b) by 1025 days.

(21) Appl. No.: 15/858,615

(22) Filed: Dec. 29, 2017

(65) Prior Publication Data

US 2019/0117484 A1 Apr. 25, 2019

(30) Foreign Application Priority Data

Oct. 23, 2017 (TW) ..... 106215571

(51) Int. Cl.

| | |
|---|---|
| ***A47C 20/04*** | (2006.01) |
| ***A61G 7/015*** | (2006.01) |
| ***A47C 19/12*** | (2006.01) |
| ***A61G 7/018*** | (2006.01) |
| ***A61G 7/05*** | (2006.01) |
| *A61G 7/16* | (2006.01) |

(52) U.S. Cl.

CPC ..... *A61G 7/018* (2013.01); *A61G 7/05* (2013.01); *A61G 7/16* (2013.01)

(58) Field of Classification Search

CPC ..... A47C 20/041; A47C 20/08; A47C 20/027
See application file for complete search history.

(56) References Cited

U.S. PATENT DOCUMENTS

| | | | | | |
|---|---|---|---|---|---|
| 2,247,516 | A * | 7/1941 | Murray | A47C 20/041 | 5/616 |
| 3,281,141 | A * | 10/1966 | Smiley | A61G 13/02 | 5/614 |
| 3,972,081 | A * | 8/1976 | Stern | A61G 7/002 | 5/618 |
| 4,349,924 | A * | 9/1982 | Zur | A47C 1/0242 | 5/615 |
| 4,535,492 | A * | 8/1985 | Sebest | A61G 7/002 | 5/616 |
| 5,737,786 | A * | 4/1998 | Yamamoto | A61G 7/0005 | 5/616 |
| 5,862,551 | A * | 1/1999 | Oguma | A61G 7/015 | 403/231 |
| 2004/0083549 | A1* | 5/2004 | L'Hegarat | A61G 13/08 | 5/621 |
| 2006/0107462 | A1* | 5/2006 | Unger | A47C 20/041 | 5/618 |

(Continued)

*Primary Examiner* — Peter M. Cuomo
*Assistant Examiner* — Ifeolu A Adeboyejo
(74) *Attorney, Agent, or Firm* — Muncy, Geissler, Olds & Lowe, P.C.

(57) ABSTRACT

An electric bed includes a base, a back frame, and a butt frame. The rear end of the back frame is attached to the base, and the back frame is swingable relative to the base by the driving of a first actuator. The butt frame is located in back of the back frame. The rear end of the butt frame is attached to the base, and the butt frame is swingable relative to the base by the driving of a second actuator. As a result, the electric bed of the invention enables the user to change the posture thereof between sitting and flat lying postures through the swinging of the back frame, and effectively supports the waist of the user through the swinging of the butt frame, so that the user can maintain the posture thereof conforming to ergonomics, thereby prevented from hurt on the waist.

6 Claims, 9 Drawing Sheets

(56) References Cited

U.S. PATENT DOCUMENTS

| | | | | |
|---|---|---|---|---|
| 2008/0178388 | A1* | 7/2008 | Schermel | A47C 31/008 5/618 |
| 2009/0178201 | A1* | 7/2009 | Lujan | A47C 20/027 5/618 |
| 2010/0017964 | A1* | 1/2010 | Kruse | A61G 7/015 5/604 |
| 2011/0101749 | A1* | 5/2011 | Shih | A47C 20/027 297/284.7 |
| 2012/0240337 | A1* | 9/2012 | Shih | A47C 20/041 5/616 |
| 2013/0145552 | A1* | 6/2013 | Bhai | A61G 7/1096 5/624 |
| 2016/0262549 | A1* | 9/2016 | Rawls-Meehan | A47C 20/027 |
| 2017/0224121 | A1* | 8/2017 | Abraham | A61G 7/07 |
| 2017/0347806 | A1* | 12/2017 | Shih | A47C 20/041 |
| 2017/0354265 | A1* | 12/2017 | Kramer | A47C 19/025 |
| 2018/0338625 | A1* | 11/2018 | Nava | A47C 19/02 |

* cited by examiner

ELECTRIC BED

BACKGROUND OF THE INVENTION

1. Field of the Invention

The present invention relates to electric beds and more particularly, to an electric bed capable of pushing the waist of the user.

2. Description of the Related Art

Many electric beds have a swingable back portion, letting the user effortlessly change the posture thereof between a sitting posture and a flat lying posture. Some electric beds even further have a liftable or bendable leg portion or a liftable head portion, letting the user adjust the sitting or lying posture thereof to the most comfortable condition according to the demands of the user. However, the presently available electric beds are not capable of pushing the waist of the user, which means no matter the user sits or flat lies on the conventional electric beds, the waist of the user is not supported effectively, so that the waist muscle stays in the tense and systolic condition. Alternatively, even the conventional electric bed has the waist-pushing function, the effect of supporting the waist of the user is not good enough and not conforms to ergonomics. The waist of the user will be damaged after a long-term accumulation.

SUMMARY OF THE INVENTION

It is a primary objective of the present invention to provide an electric bed which is capable of pushing the waist of the user, providing good support to the waist of the user.

To attain the above objective, the present invention provides an electric bed which includes a base, a back frame, a first actuator, a butt frame, and a second actuator. A rear end of the back frame is attached to the base in a way that the back frame is swingable. The first actuator is disposed between the base and the back frame for driving the back frame to swing. The butt frame is located in back of the back frame. A rear end of the butt frame is attached to the base in a way that the butt frame is swingable. The second actuator is disposed between the base and the butt frame for driving the butt frame to swing.

As a result, the electric bed of the invention not only enables the user to change the posture thereof between sitting and flat lying postures through the swinging of the back frame, but also effectively supports the waist of the user through the swinging of the butt frame, causing the sitting or lying posture of the user conform to ergonomics, thereby preventing the waist of the user from hurt by unhealthy posture.

DETAILED DESCRIPTION OF THE INVENTION

Figure 1:
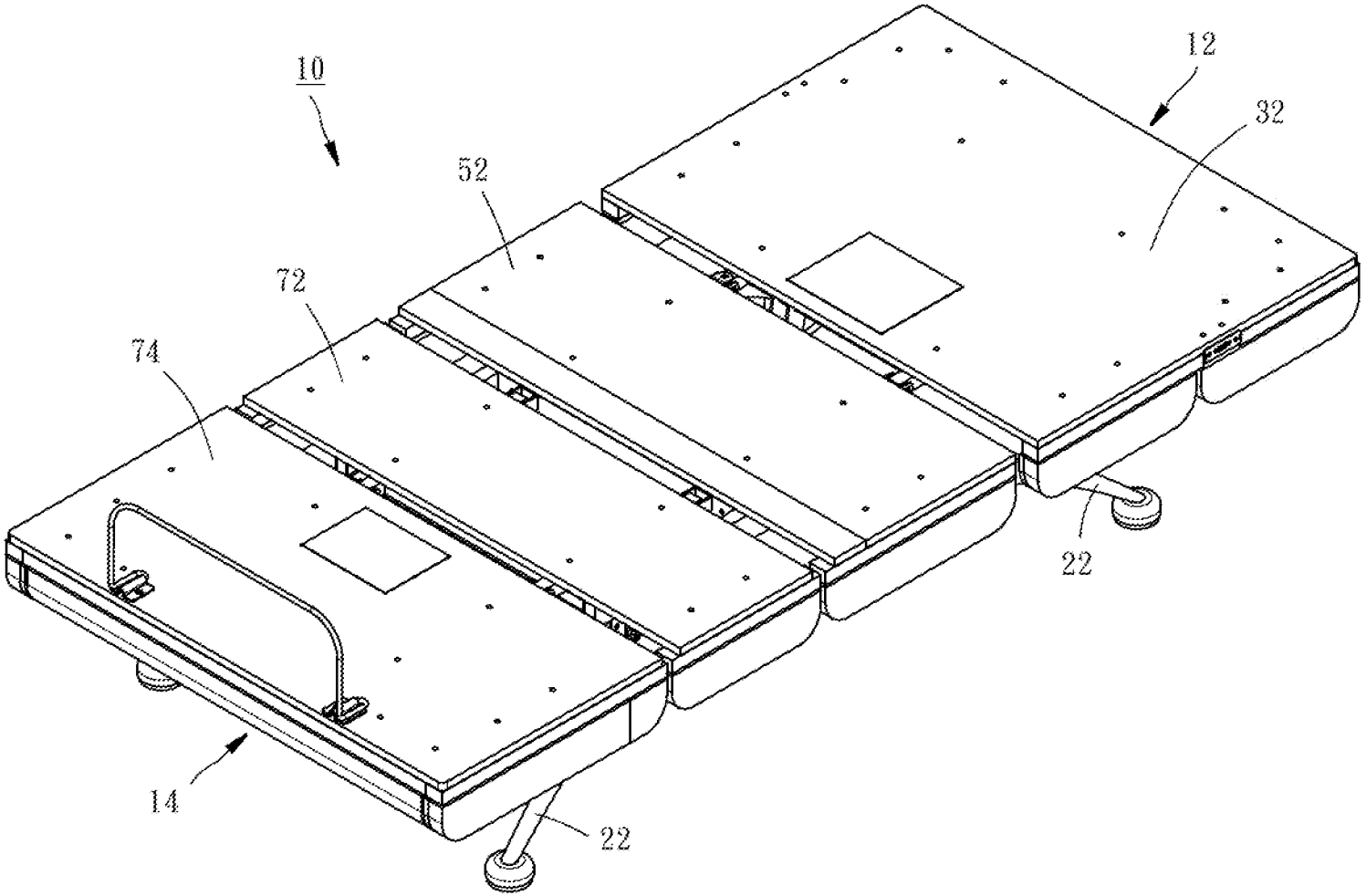
FIG. 1 is a perspective view showing the appearance of an electric bed of the present invention.
Figure 2:
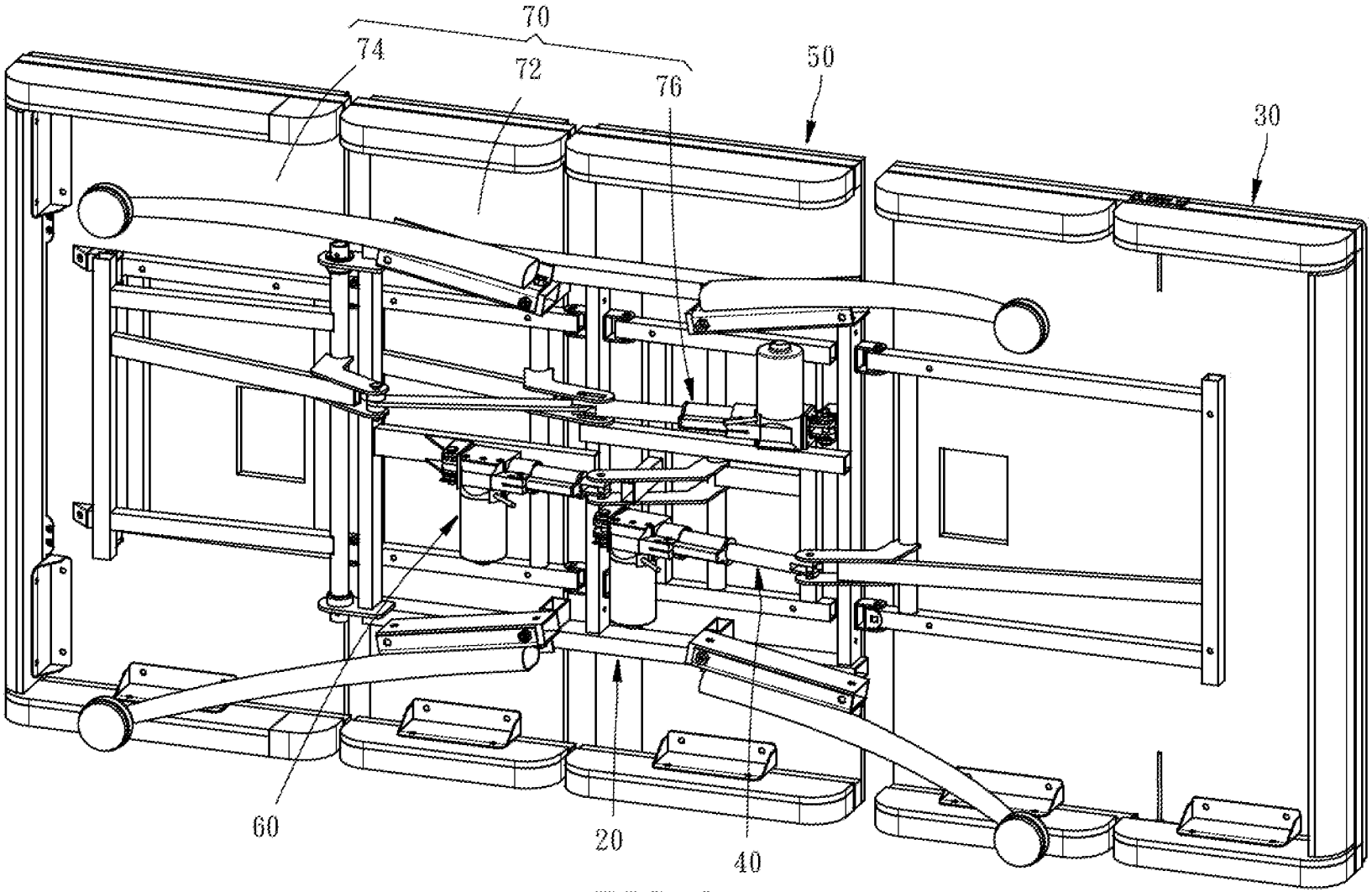
FIG. 2 is a perspective view showing the appearance of the electric bed of the present invention, which is viewed from a different angle from FIG. 1.
Figure 3:
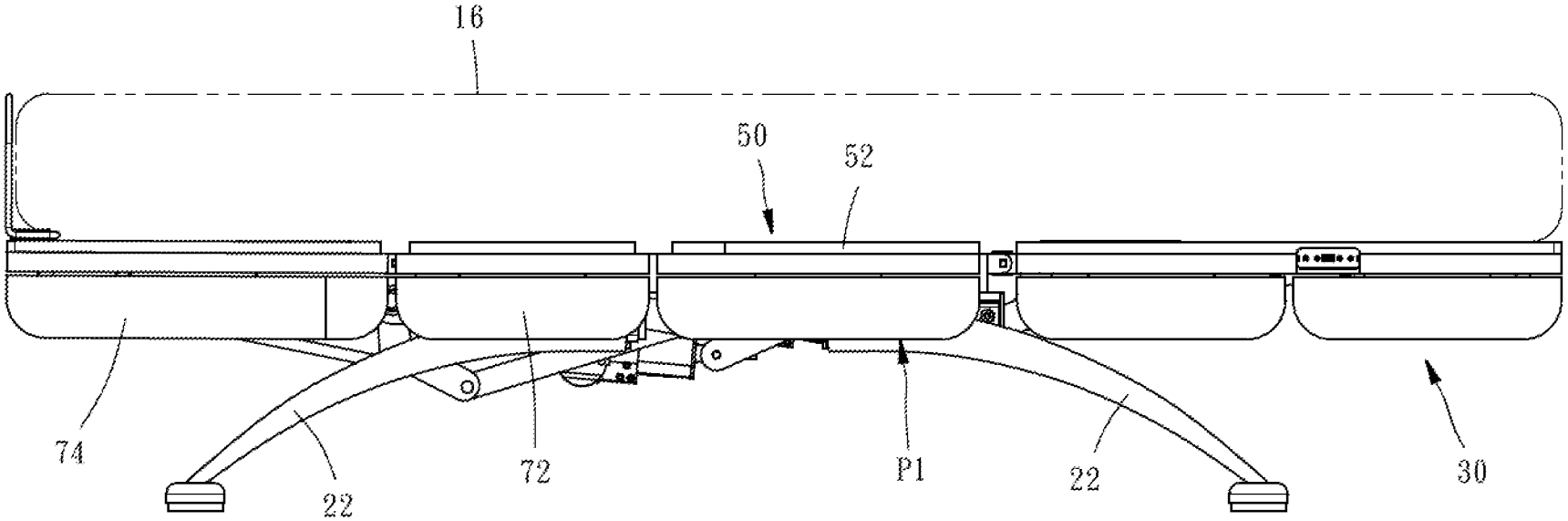
FIG. 3 is a side view of the electric bed of the present invention, primarily showing a butt frame is located at a horizontal position.

Referring to FIGS. 1-2, the electric bed 10 of the present invention includes a base 20, a back frame 30, a first actuator 40, a butt frame 50, and a second actuator 60. In the following embodiment of the invention, the front is defined at the head portion 12 and the back is defined at the feet portion 14. The electric bed 10 is adapted for a mattress 16 to be placed thereon, as shown in FIG. 3.

The base 20 is approximately a rectangular frame which is an assembly of a plurality of rods connected with each other. The base 20 is provided at four corners thereof with four supporting feet 22 respectively for being abutted on the floor.

Figure 7:
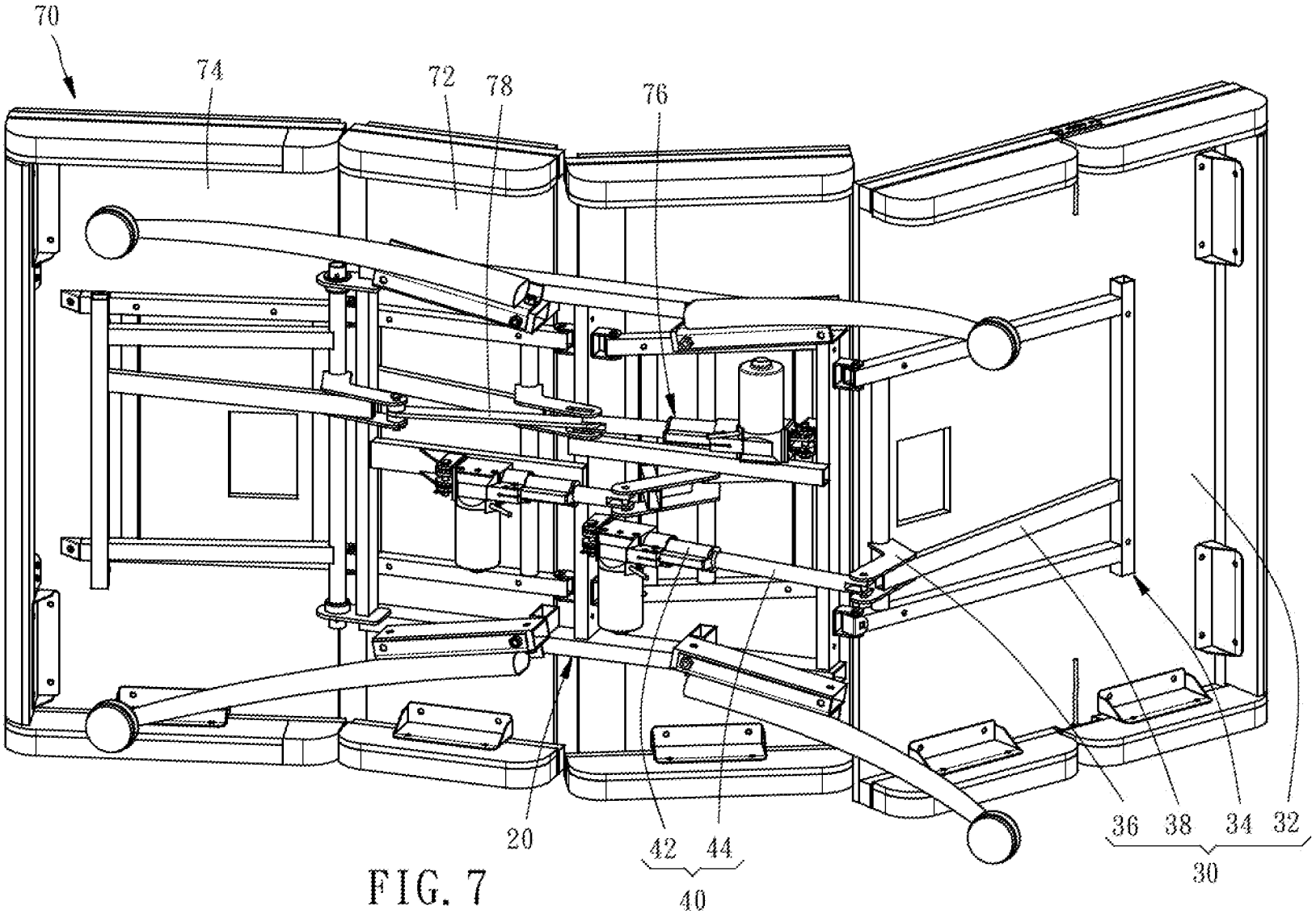
FIG. 7 is a perspective view showing the bottom of the electric bed in the condition of FIG. 6, wherein a first actuator is in an extended condition.

The back frame 30 has a back plate 32, a back-plate supporter 34, a first downward link 36 and a first connecting link 38, as shown in FIG. 7. The back-plate supporter 34 is disposed on the back surface of the back plate 32. The rear end of the back-plate supporter 34 is attached to the front end of the base 20 in a way that the back-plate supporter 34 is swingable. The first downward link 36 is extended downwardly from the rear end of the back-plate supporter 34. The first connecting link 38 connects the front end of the back-plate supporter 34 and the first downward link 36.

The first actuator 40 has a first cylinder body 42 and a first piston rod 44. The first piston rod 44 is inserted in the first cylinder body 42 and capable of being frontward extended out from the first cylinder body 42 or retracted back, so that the first actuator 40 can be extended or shortened, thereby driving the back frame 30 to swing upwardly or downwardly. In this embodiment, the front end of the first actuator 40, i.e. the front end of the first piston rod 44, is pivotably attached to the first downward link 36 of the back frame 30; the rear end of the first actuator 40, i.e. the rear end of the first cylinder body 42, is pivotably attached to the base 20.

Figure 5:
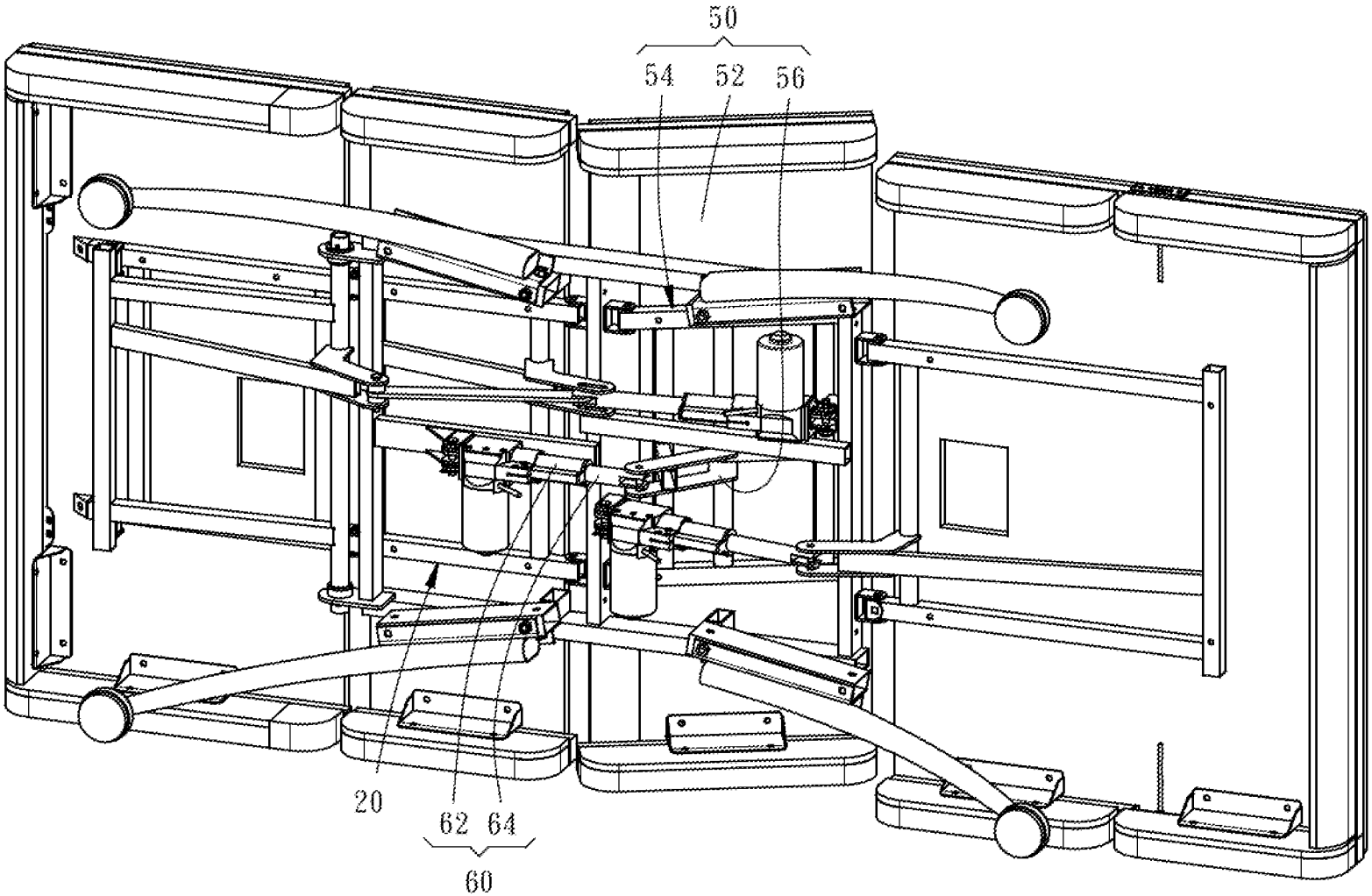
FIG. 5 is a perspective view showing the bottom of the electric bed in the condition of FIG. 4, wherein a second actuator is in an extended condition.

The butt frame 50 is located in back of the back frame 30, and has a butt plate 52, a butt-plate supporter 54 and a second downward link 56, as shown in FIG. 5. The butt-plate supporter 54 is disposed on the back surface of the butt plate 52. The rear end of the butt-plate supporter 54 is attached to the base 20 in a way that the butt-plate supporter 54 is swingable. The second downward link 56 is extended downwardly from the butt-plate supporter 54.

Figure 4:
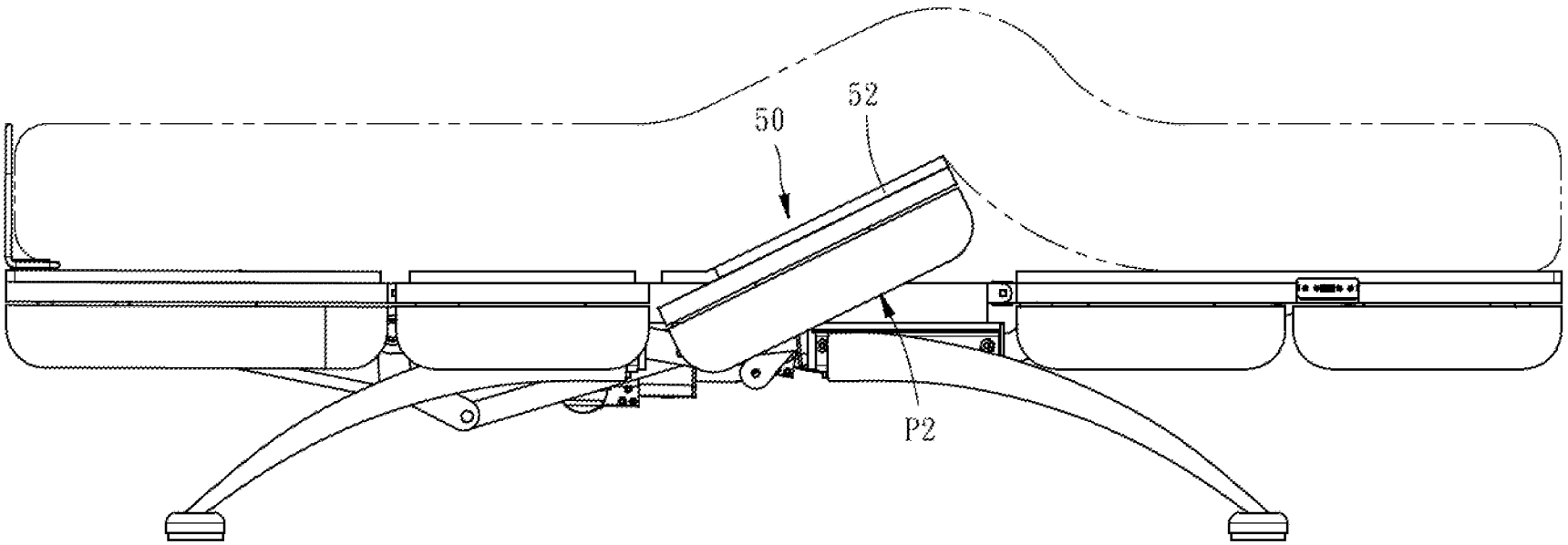
FIG. 4 is a side view of the electric bed of the present invention, primarily showing the butt frame is located at an inclined position.

The second actuator 60 has a second cylinder body 62 and a second piston rod 64. The second piston rod 64 is inserted in the second cylinder body 62 and capable of being frontward extended out from the second cylinder body 62 or retracted back, so that the second actuator 60 can be extended or shortened, thereby driving the butt frame 50 to swing between a horizontal position P1 as shown in FIG. 3 and an inclined position as shown in FIG. 4. Of course, the butt frame 50 can swing to other positions depending on the usage requirement. In this embodiment, as shown in FIG. 5, the front end of the second actuator 60, i.e. the front end of the second piston rod 64, is pivotably attached to the second downward link 56 of the butt frame 50; the rear end of the second actuator 60, i.e. the rear end of the second cylinder body 62, is pivotably attached to the base 20.

Besides, as shown in FIG. 2, the electric bed 10 of the invention further includes a lower-limbs loading unit 70 having a thigh frame 72, a shank frame 74 and a third actuator 76. The thigh frame 72 is located in bake of the butt frame 50. The front end of the thigh frame 72 is pivotably attached to the base 20. The shank frame 74 is located in back of the thigh frame 72. The front end of the shank frame 74 is pivotably attached to the rear end of the thigh frame 72. The third actuator 76 is disposed between the base 20 and the thigh frame 72 and pivotably connected with the shank frame 74 by a second connecting link 78 as shown in FIG. 7, so that the third actuator 76 can drive the thigh and shank frames 72, 74 to swing at the same time. The lower-limbs loading unit 70 is mentioned only for subsidiary illustration of the invention, not a necessary member of the invention. Therefore, the structure of the lower-limbs loading unit 70 can be modified, and the electric bed can even have no such lower-limbs loading unit 70.

The following is the illustration of the operation of the electric bed 10 of the invention. When the electric bed 10 is in the original condition, the back frame 30, the butt frame 50, the thigh frame 72 and the shank frame 74 are appeared in the horizontal condition as shown in FIG. 3; at this time, the electric bed 10 is adapted for the user to flat lie on the mattress 16. When the user wants to stretch the waist muscle thereof at the flat lying posture, the user firstly controls the second actuator 60 to be extended to move the butt frame 50 from the horizontal position P1 as shown in FIG. 3 to the inclined position P2 as shown in FIG. 4. At this time, as shown in FIG. 5, the front end of the second actuator 60, i.e. the front end of the second piston rod 64, pushes the second downward link 56 of the butt frame 50 to move frontward, so as to drive the butt frame 50 to swing upwardly. The upwardly swinging butt frame 50 pushes the waist of the user, letting the waist muscle of the user stretched.

Figure 8:
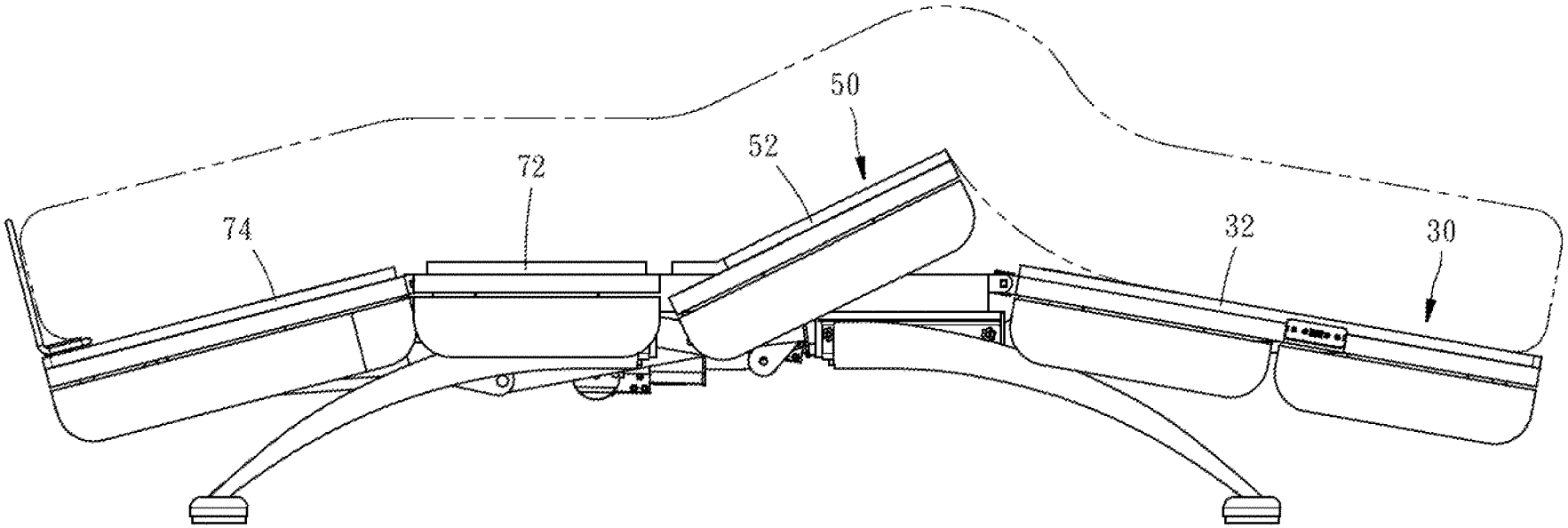
FIG. 8 is a side view of the electric bed of the present invention, primarily showing the back frame is in a lowered condition and the butt frame is located at the inclined position.
Figure 9:
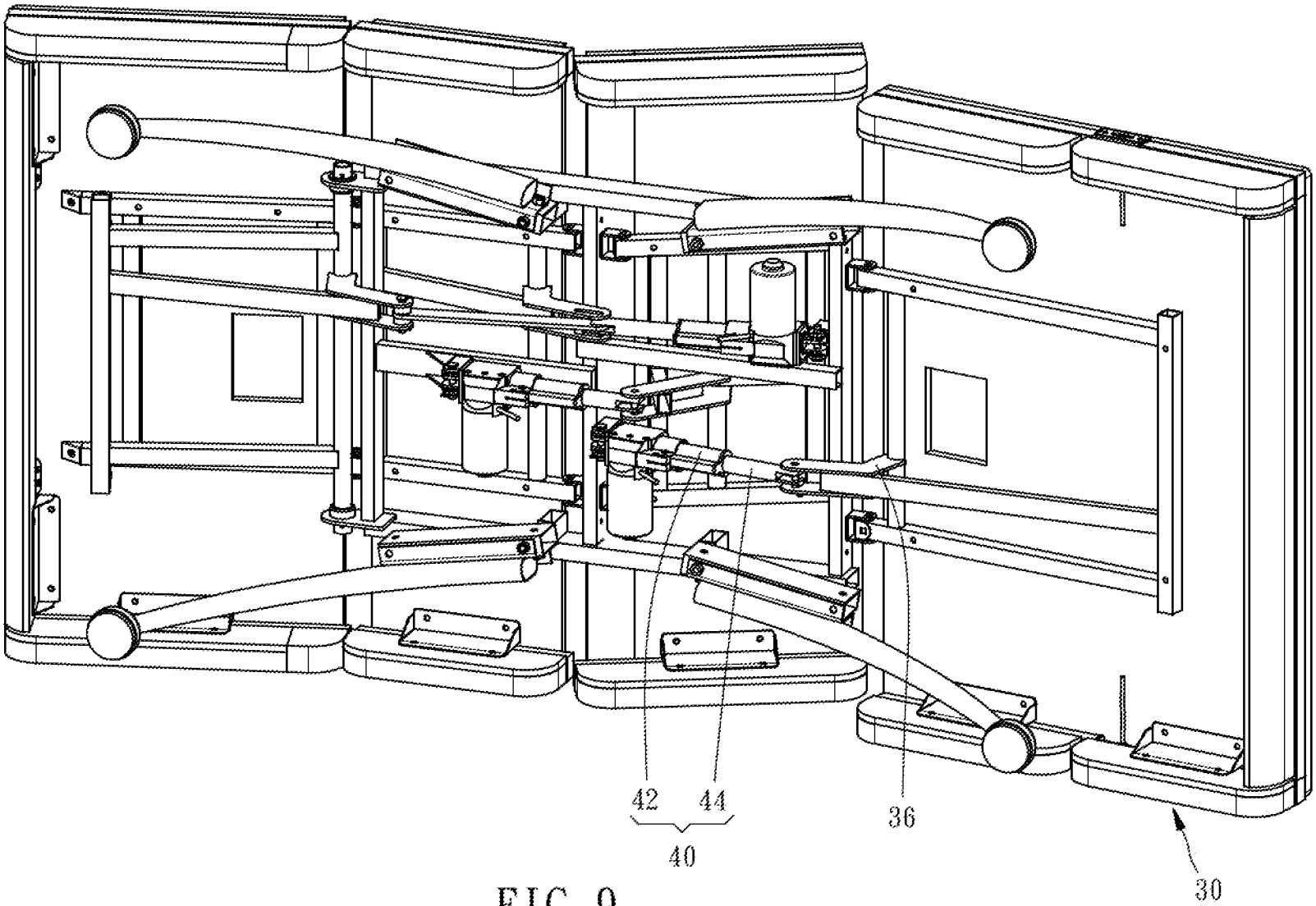
FIG. 9 is a perspective view showing the bottom of the electric bed in the condition of FIG. 8, wherein the first actuator is in a shortened condition.

When the user wants to lift the back thereof, the user controls the first actuator 40 to be extended as shown in FIG. 7 to cause the front end of the first actuator 40, i.e. the front end of the first piston rod 44, to push the first downward link 36 of the back frame 30 to move frontward, thereby driving the back frame 30 to swing upwardly. The lifted back frame 30 changes the posture of the user from the lying posture to the sitting posture; at this time, the butt frame 50 can support the waist of the user. In opposite, as shown in FIG. 9, when the user controls the first actuator 40 to be shortened to cause the front end of the first actuator 40, i.e. the front end of the first piston rod 44, to pull the first downward link 36 of the back frame 30 to move backward, the back frame 30 swings downwardly to the backward inclined condition as shown in FIG. 8. At this time, the backward-inclined back frame 30 and the pushing of the butt frame 50 can relax the whole waist and back muscle of the user.

Figure 6:
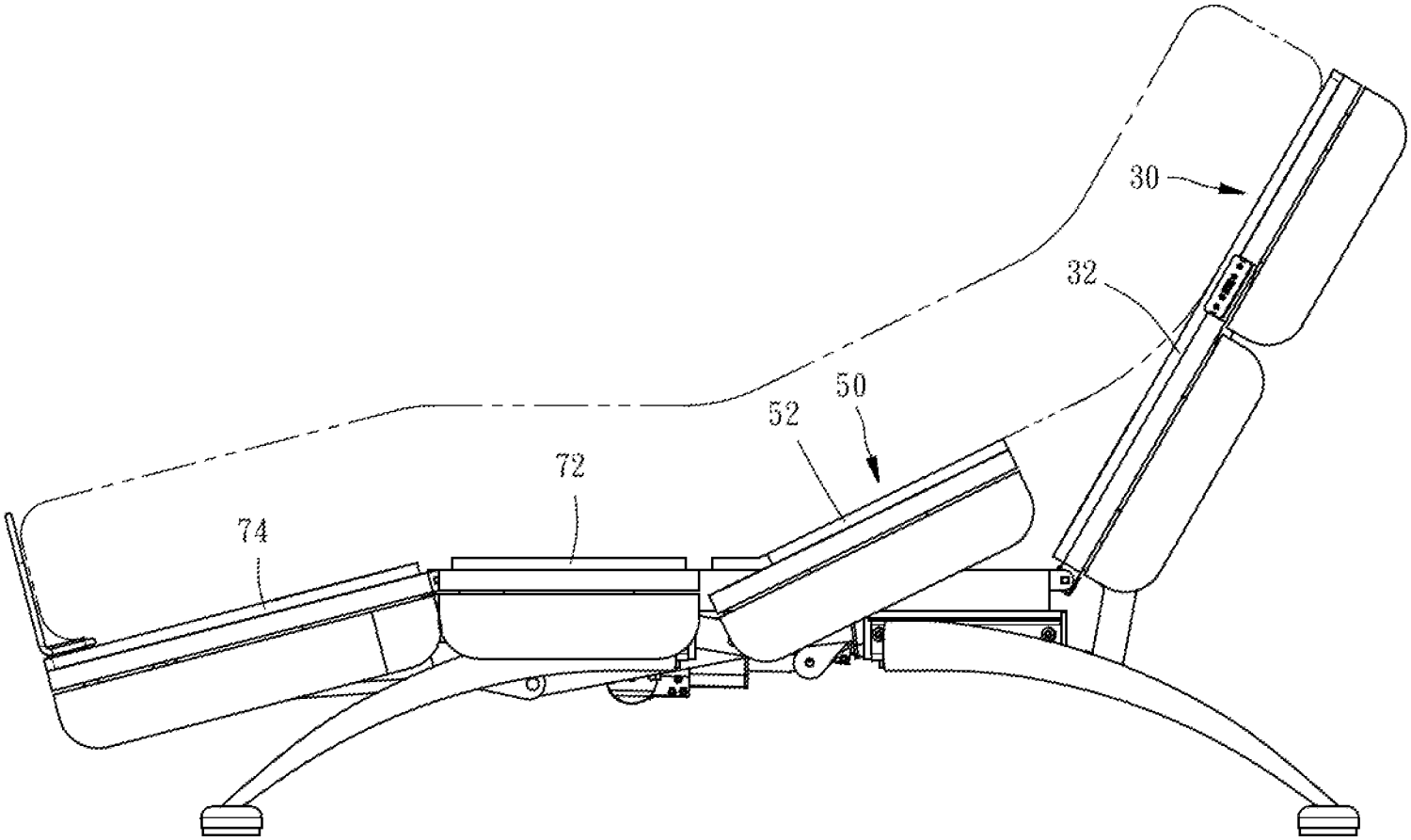
FIG. 6 is a side view of the electric bed of the present invention, primarily showing a back frame is in a lifted condition and the butt frame is located at the inclined position.

When the user wants to bend the knees thereof at the lying posture or sitting posture, the user controls the third actuator 76 to be shortened as shown in FIG. 7, so that the second connecting link 78 pulls the shank frame 74 to swing downwardly to attain the bending condition as shown in FIGS. 6 and 8. In opposite, when the third actuator 76 is controlled to be extended, the rear end of the third actuator 76 pushes the thigh frame 72 to move backward, causing the thigh frame 72 to swing upwardly, and then the shank frame 74 is lifted along with the thigh frame 72.

As a result, the electric bed 10 of the present invention has such special structural design that the butt frame 50 can swing upwardly, thereby providing the function of pushing the waist of the user, so that the waist of the user with the sitting posture can be effectively supported, thereby prevented from hurt by unhealthy posture. In additional, when the user flat lies on the electric bed 10, the butt frame 50 can stretch the waist muscle of the user. Besides, the swinging angel of the butt frame 50 can be adjusted according to the demands of the user, so that the pushing-waist function of the butt frame 50 can maintain the user at the comfortable posture to conform with ergonomics. On the other hand, when the electric bed 10 of the invention is used to push the waist of the user by the butt frame 50, the back frame 30 can be additionally functioned to swing upwardly and downwardly, for lifting the back of the user and backward bending the waist of the user.

Based on the spirit of the invention, the electric bed 10 of the invention may be modified. For example, the first and second actuators 40, 60 may be other kinds of actuator, such as pneumatic cylinders, hydraulic cylinders, or electric motors. Besides, the positions of the first cylinder body 42 and the first piston rod 44 of the first actuator 40 can be exchanged, and the positions of the second cylinder body 62 and the second piston rod 64 of the second actuator 60 can be exchanged. For example, the first cylinder body 42 and the first piston rod 44 of the first actuator 40 can be pivotably attached to the first downward link 36 of the back frame 30 and the base 20 respectively, and the second cylinder body 62 and the second piston rod 64 of the second actuator 60 can be pivotably attached to the second downward link 56 of the butt frame 50 and the base 20 respectively, as long as the length of the first and second actuators 40, 60 can be changed. The connection between the second actuator 60, the butt frame 50 and the base 20 can be modified in a way that when the second actuator 60 is shortened, it drives the butt frame 50 to swing from the horizontal position P1 to the inclined position P2. The structure of the butt frame 50 can be modified, such as having no such second downward link 56.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electric bed, front of the electric bed being defined at a head portion of the electric bed and rear of the electric bed being defined at a feet portion of the electric bed, the electric bed comprising:

a base;

a back frame, a rear end of which is attached to the base in a way that the back frame is swingable;

a first actuator disposed between the base and the back frame for driving the back frame to swing;

a butt frame having a top surface for supporting a user's butt and located in back of the back frame, a rear end of the butt frame being attached to the base in a way that the butt frame is swingable in a way that a front end of the butt frame is movable up and down to change an angle between the top surface of the butt frame and the back frame, wherein the rear end of the butt frame is farther from the head portion of the electric bed than the front end of the butt frame is; and a second actuator disposed between the base and the butt frame for driving the butt frame to swing.

2. The electric bed as claimed in claim 1, wherein the butt frame has a butt-plate supporter and a second downward link extended downwardly from the butt-plate supporter; the second actuator is connected with the second downward link.

3. The electric bed as claimed in claim 2, wherein the second actuator has a front end pivotably attached to the second downward link of the butt frame, and a rear end pivotably attached to the base.

4. The electric bed as claimed in claim 1, wherein the second actuator is one of an electric motor and a pneumatic cylinder.

5. The electric bed as claimed in claim 4, wherein the butt frame is swingable between a horizontal position and an inclined position.

6. The electric bed as claimed in claim 5, wherein during the second actuator is extended, it causes the butt frame to swing from the horizontal position to the inclined position.

* * * * *